United States Patent [19]

Tamii et al.

[11] Patent Number: 4,949,090

[45] Date of Patent: Aug. 14, 1990

[54] TRANSMIT/RECEIVE MODULE TEST SYSTEM

[75] Inventors: Seizo Tamii; Norio Mutoh; Hiroshi Hasegawa; Hiroshi Okamura; Noriyuki Tanii, all of Amagasaki, Japan

[73] Assignee: Mitsubishi Denki Kabushiki Kaisha, Tokyo, Japan

[21] Appl. No.: 313,492

[22] Filed: Feb. 22, 1989

[30] Foreign Application Priority Data

Feb. 22, 1988 [JP] Japan ..... 63-41546

[51] Int. Cl.[5] ..... H01Q 21/22

[52] U.S. Cl. ..... 342/173; 342/372

[58] Field of Search ..... 342/165, 173, 368, 372; 343/703, 778

[56] References Cited

U.S. PATENT DOCUMENTS 4,176,354 11/1979 Hsiao et al. .
4,532,518 7/1985 Gaglione et al. .
4,639,732 1/1987 Acoraci et al. .
4,791,421 12/1988 Morse et al. .

FOREIGN PATENT DOCUMENTS 61-67885 7/1986 Japan .
63-40403 2/1988 Japan .

*Primary Examiner*—Thomas H. Tarcza
*Assistant Examiner*—Mark Hellner

[57] ABSTRACT

A phased-array antenna is provided with a dummy antenna element and a dummy transmit/receive module for testing the other transmit/receive modules by transmitting test signals to, or receiving test signals from, the other antenna elements in the array. Test signals are transmitted in a test mode that alternates with normal-mode operation. Receive power level and/or phase can be checked. The transmit/receive modules in the array are simplified in structure and improved in reliability due to the elimination of special receive check circuits. Antenna accuracy can also be improved by adjusting the phase shifters in the transmit/receive modules to compensate for variations in transmission phase.

43 Claims, 5 Drawing Sheets

TRANSMIT/RECEIVE MODULE TEST SYSTEM

BACKGROUND OF THE INVENTION

This invention relates to an improved system for testing the transmit/receive modules of a phased-array antenna apparatus.

Phased-array antennas are used in, for example, radar systems since they can scan wide areas while remaining stationary. A phased-array antenna includes an array of antenna elements, each having its own transmit/receive module for transmitting and receiving signals via the antenna element. Each transmit/receive module includes a phase shifter. The total antenna beam is steered by controlling the phase shifts in the transmit/receive modules.

To confirm normal operation of a phased-array antenna, it is necessary to test the receive circuits of the individual transmit/receive modules. A prior scheme for such testing equips each transmit/receive module with a receive check circuit that diverts part of the unamplified transmit signal from the transmit section of the module to the receive section of the same module. During normal operation, the receive check circuit is switched off, so that the transmit signal is not diverted into the receive section. During a test, the receive check circuit is switched on and the part of the unamplified transmit signal diverted into the receive section is used as a test signal.

A problem with this scheme is that the receive check circuits themselves may malfunction. If the switch in the receive check circuit becomes stuck in the on-state, for example, then during normal operation, part of the amplified receive signal will be fed back via the receive check circuit thereby into the receive circuit, setting up an oscillation. Even one of the transmit/receive modules oscillating in this way can seriously distort the total received signal power, thereby causing the antenna array to fail as a whole.

SUMMARY OF THE INVENTION

It is accordingly an object of the present invention to provide an improved system for testing the transmit/-receive modules of a phased-array antenna, in which the transmit/receive module structure is simplified and a failure in one transmit/receive module does not disable the entire array.

A transmit/receive module test system according to the present invention includes a dummy antenna element for transmitting signals to, or receiving signals from, the antenna elements of the phased-array antenna, and a dummy transmit/receive module connected to the dummy antenna element, for amplifying the signals transmitted from, or received by, the dummy antenna element. Different embodiments of this transmit/-receive module test system are provided with various detectors utilized for checking the power or phase of the signals transmitted from or received by the dummy antenna element.

DETAILED DESCRIPTION OF THE EMBODIMENTS

A first novel transmit/receive module test system according to the present invention will be described with reference to FIGS. 1 to 3. This transmit/receive module test system tests the transmit/receive modules in a phased array to ascertain whether their receive circuits are functioning normally.

Figure 1:
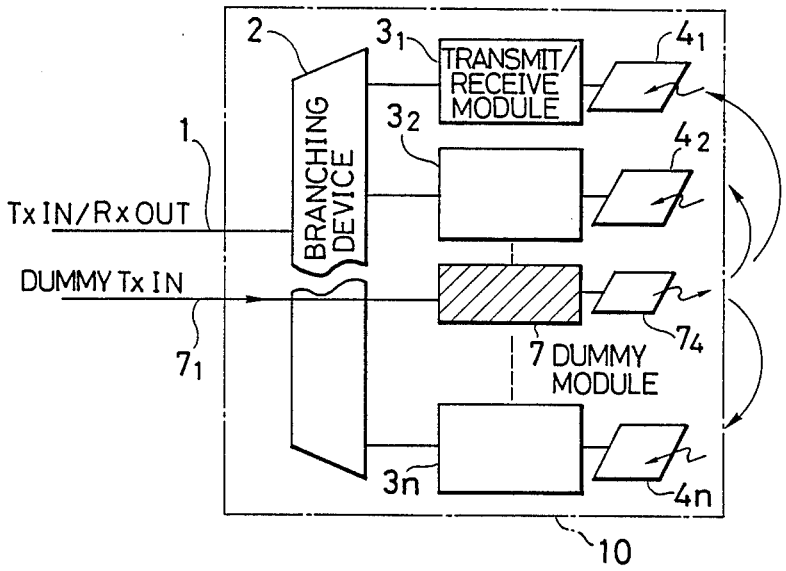
FIG. 1 is a block diagram of a phased-array antenna employing the transmit/receive module test system of the present invention for receive circuit checking.

FIG. 1 is a block diagram of a phased-array antenna employing the novel transmit/receive module test system. The phased-array antenna apparatus in FIG. 1 comprises a signal line 1 for input and output of an rf transmit input signal and an rf receive output signal, a branching device 2 for dividing and combining these signals, transmit/receive modules $3_1$ to $3_n$, antenna elements $4_1$ to $4_n$, a dummy module 7, a dummy transmit signal input line $7_1$, and a dummy antenna element $7_4$. The dummy module 7 will be assumed to be identical to the transmit/receive modules $3_1$ to $3_n$.

Figure 2:
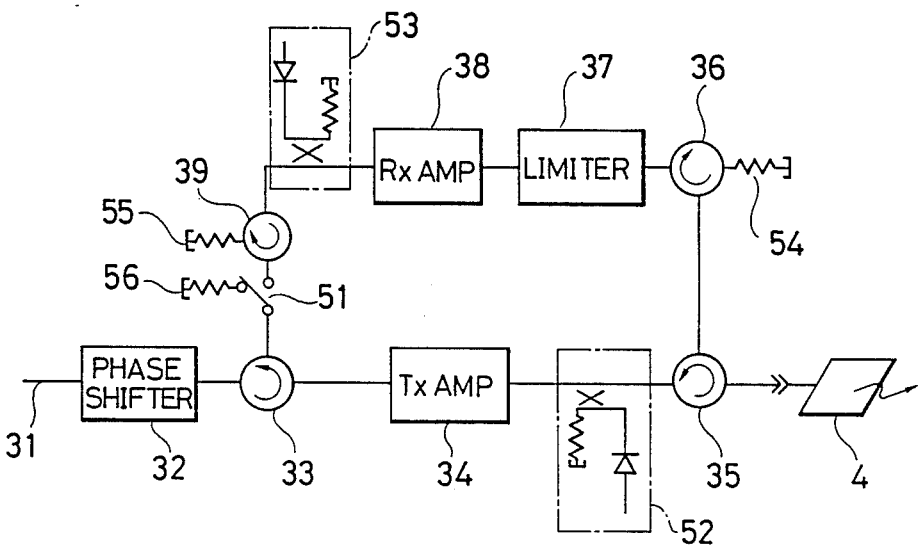
FIG. 2 is a more detailed block diagram of the transmit/receive modules in FIG. 1.

FIG. 2 is a block diagram showing the configuration of a transmit/receive module in FIG. 1. The transmit/-receive module in FIG. 2 comprises a signal input/output line 31, a phase shifter 32, a circulator 33, a transmit amplifier 34, a circulator 35, an isolator 36, a limiter 37, a low-noise amplifier 38, an isolator 39, a switch 51, a transmit power detector 52, a receive power detector 53, and terminating resistors 54 to 56. It does not have a separate receive check circuit as was the case in the prior devices.

First the normal-mode operation of the antenna will be described. For transmission, the switch 51 in each transmit/receive module is placed in the off-state. The rf transmit signal is input via the signal line 1 to the branching device 2, which distributes it to the transmit/receive modules $3_1$ to $3_n$. In each transmit/receive module the phase shifter 32 shifts the phase of the transmit signal by a specified amount, the transmit amplifier 34 amplifies the signal, and the transmit power detector 52 checks the power level of the amplified signal. The signals that have been thus shifted, amplified, and checked are then transmitted from respective antenna elements $4_1$ to $4_n$. For reception, the switch 51 in each transmit/receive module is placed in the on-state. The signals received by the antenna elements $4_1$ to $4_n$ are fed to respective transmit/receive modules $3_1$ to $3_n$, wherein each signal is limited by the limiter 37, amplified by the low-noise amplifier 38. They are then checked by the receive power detector 53, and applied through the switch 51 to the phase shifter 32. The phase shifter 32 then shifts its phase by a specified amount. The phase-shifted receive signals from the transmit/-receive modules $3_1$ to $3_n$ are then sent, via the signal lines 31, to the branching device 2, which combines them into a single receive output signal. In normal-mode transmit and receive operations, no signal is sent on the dummy transmit signal line $7_1$ and the dummy module 7 is inoperative.

Next the test-mode operation will be described. In this mode, in the transmit/receive modules $3_1$ to $3_n$, the transmit amplifiers 34 are switched off and the low-noise amplifiers 38 are switched on. Concurrently, in the dummy module 7, the transmit amplifier 34 is switched on and the low-noise amplifier 38 is switched off. A dummy transmit signal is input via the dummy transmit signal line $7_1$ to the dummy module 7 and transmitted from the dummy antenna element $7_4$. The antenna elements $4_1$ to $4_n$ receive the signal radiated from the dummy antenna element $7_4$. In each transmit/-receive module $3_1$ to $3_n$, the received signal is amplified by the low-noise amplifier 38. The receive power detector 53 checks the output of the low-noise amplifier 38 and decides whether the receive circuits are operating normally. This check is carried out in all the transmit/-receive modules $3_1$ to $3_n$, without requiring a separate checking circuit in each module as in the prior devices.

Figure 3:
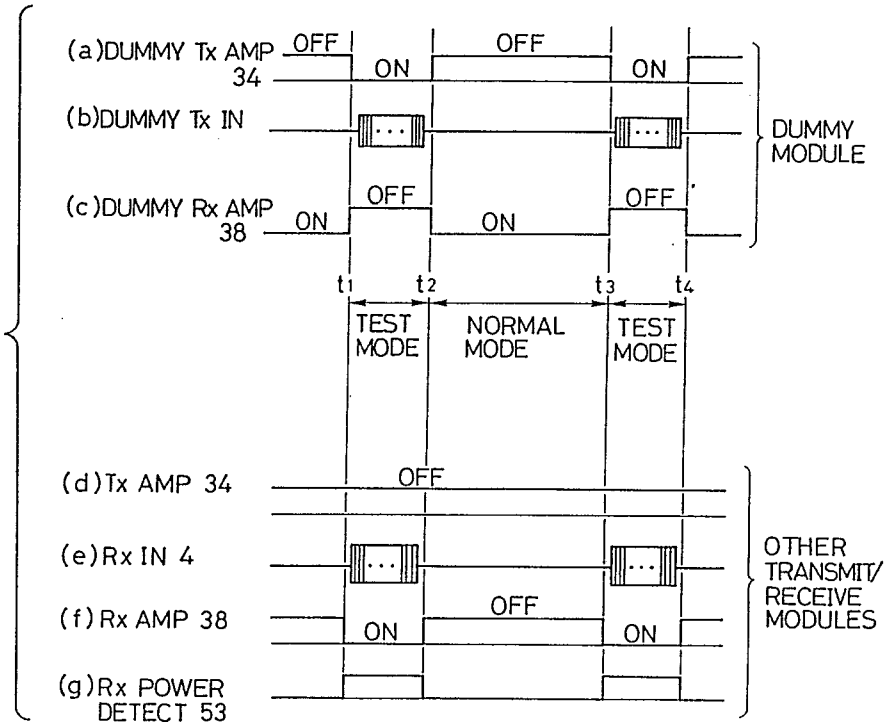
FIG. 3 is a timing chart illustrating the operation of the phased-array antenna in FIGS. 1 and 2.

The normal and test operation modes are further illustrated by the timing chart in FIG. 3. Lines (a) to (c) in FIG. 3 indicate the operation of the dummy module 7. Lines (d) to (g) indicate the operation of the transmit/receive modules $3_1$ to $3_n$. The phased-array antenna operates in the test mode during the intervals $t_1$ to $t_2$ and $t_3$ to $t_4$, and in the normal mode at other times.

The antenna elements $4_1$ to $4_n$ are at various distances from the dummy antenna element $7_4$, so the signals they receive are not identical in power. Since the signals are all received directly from an antenna element in the same array, however, the input levels to their low-noise amplifier 38 are all more than adequate. For modules close to the dummy module 7, the receive power input to the low-noise amplifier 38, may be excessive but this excessive input power is absorbed by a dummy resistor 54 coupled to the isolator 36. All the modules in the array are thus able to check their receiving systems simultaneously.

A second novel transmit/receive module test system according to the present invention, will be described with reference to FIGS. 4 to 6. This transmit/receive module test system checks the transmission phase of the receive circuits in the transmit/receive modules of the phased array. The transmission phase tends to vary due to temperature fluctuations and aging changes. Adverse effect on reception can be prevented, however, by detecting the changes in transmission phase and adjusting the phase shifters so as to compensate.

Figure 4:
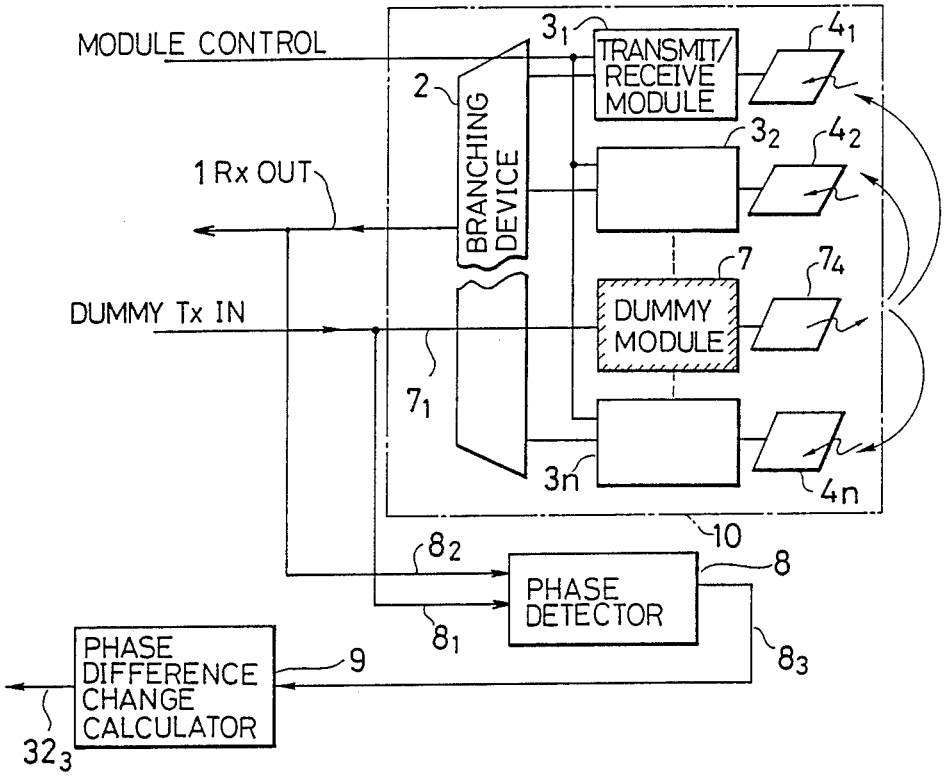
FIG. 4 is a block diagram of another phased-array antenna employing the transmit/receive module. test system of the present invention for receive phase adjustment.
Figure 5:
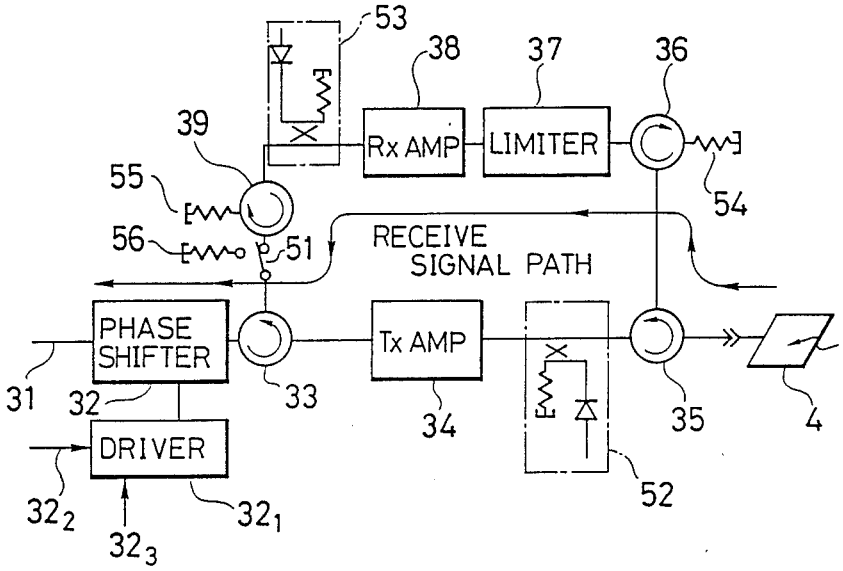
FIG. 5 is a more detailed block diagram of the transmit/receive modules in FIG. 4.

FIG. 4 is a block diagram of a phased-array antenna employing the second novel transmit/receive module test system. The phased-array antenna in FIG. 4 is similar to that in FIG. 1, but also comprises a phase detector 8 which receives the dummy transmit signal via a dummy transmit signal input line $8_1$, and receives the receive signals from the transmit/receive modules $3_1$ to $3_n$ via a receive signal input line $8_2$. FIG. 5 is a block diagram of the transmit/receive modules $3_1$ to $3_n$ in FIG. 4. These are substantially identical to the transmit/receive modules in FIG. 2, but FIG. 5 also shows the driver $32_1$ of the phase shifter 32 and its input phase control signal line $32_2$, which were not provided in the module shown in FIG. 2.

The test-mode operation of this phased-array antenna is similar to that described in FIGS. 1 to 3, except that it tests the phase of the receive signals. The phase detector 8 detects the phase of the signals on the dummy module transmit signal input line $8_1$ and the receive signal input line $8_2$ and generates a signal indicating their phase difference on the phase difference output line $8_3$. The change in the phase difference is calculated by a phase difference change calculator 9 and supplied to the driver $32_1$ of the phase shifter 32 in the corresponding module, where it is added to or substracted from the phase control signal $32_2$ supplied to the driver $32_1$. The phase shifter 32 thus compensates for changes in the transmission phase of the receive system.

Figure 6:
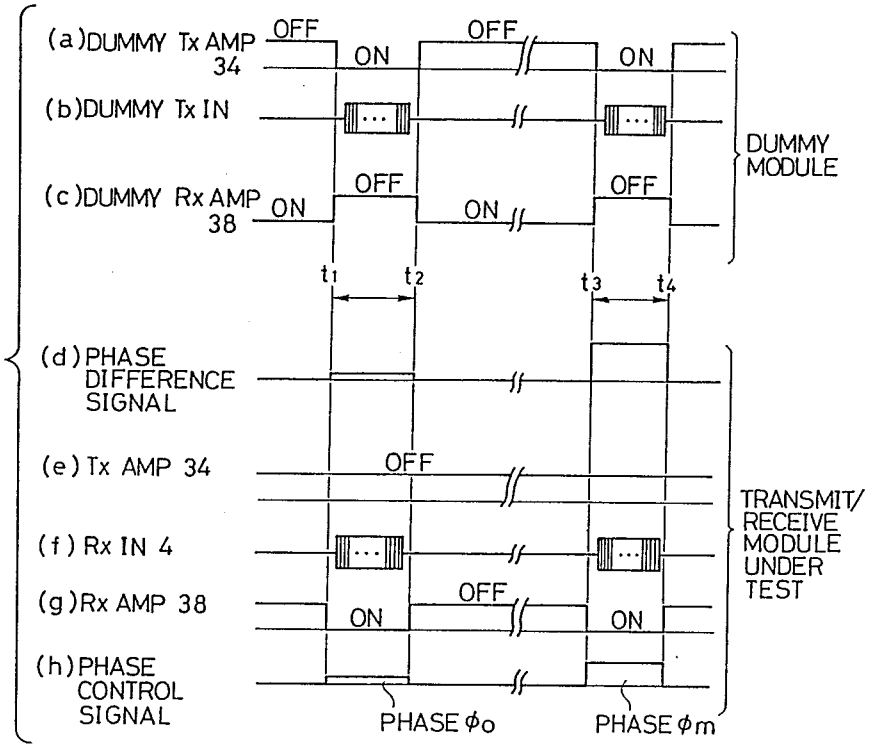
FIG. 6 is a timing chart illustrating the operation of the phased-array antenna in FIGS. 4 and 5.

A timing chart of the phase check operation is shown in FIG. 6. If the phase difference detected in the interval $t_1$–$t_2$ and the phase difference detected in the interval $t_3$–$t_4$ are different as shown in line (d) of FIG. 6, the difference is added to, or substracted from, the phase control signal $32_2$ to correct the phase of the receiving system.

The transmission phase of the receive circuits in each transmit/receive module is checked separately in this way. A module control signal as shown in FIG. 4 can be used to select the transmit/receive module to be tested and disable the other transmit/receive modules. The receive circuits in the transmit/receive module can also be tested by checking the receive power as in FIGS. 1 to 3, and this test can be performed on all transmit/-receive modules simultaneously.

Figure 7:
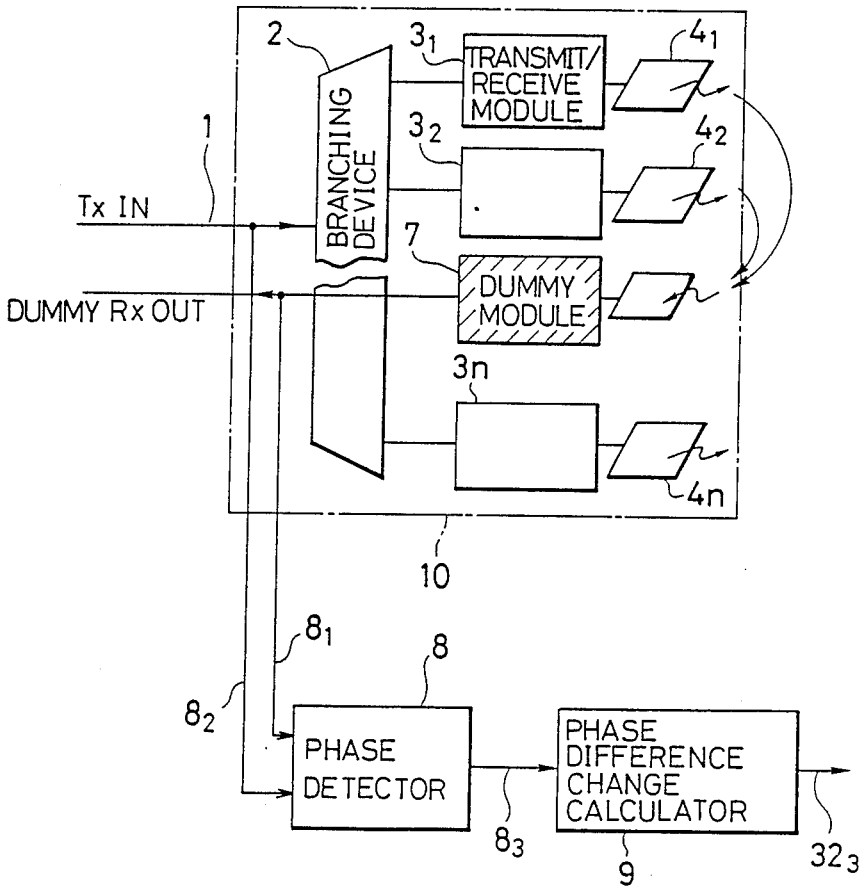
FIG. 7 is a block diagram of a phased-array antenna employing the transmit/receive module test system of the present invention for transmit phase adjustment.

This invention can also provide a system for checking the transmission phase of the transmit circuits, as will be described with reference to FIG. 7. The novel transmit/receive module test system in FIG. 7 differs from those in FIGS. 4 to 6 in that the dummy module 7, instead of transmitting a test signal to the other modules, receives a sequence of test signals transmitted from the other modules in turn. The phase detector 8, for detecting the phase difference between the transmit and receive signals, is similar to that in FIG. 4 and is connected by similar signal lines $8_1$, $8_2$, and $8_3$; further description will be omitted. The system illustrated in FIG. 7 can also be used to ascertain whether the transmitting circuits in the transmit/receive modules $3_1$ to $3_n$ are operating normally by checking the power received at the dummy antenna element $7_4$.

By using a single dummy module and antenna element for the entire antenna array, instead of a receive check circuit in every transmit/receive module, the novel transmit/receive module test systems described above simplify the structure of the transmit/receive modules of the phased-array antenna and thereby improve their reliability to a substantial degree. In the simplified transmit/receive modules, the danger of feedback from the receive check circuit to the receive section is avoided, so that while failure of a single transmit/receive module may slightly degrade the performance of the phased-array antenna, it cannot produce disabling oscillations as was the case in the prior devices. A further advantage of the novel test systems is that they also provide means of checking the transmission phase of the transmit and receive circuits in the array and adjusting the phase shifters to compensate for variations, thus improving the accuracy of the phased-array antenna.

The scope of this invention is not limited to the embodiments illustrated in the drawings, but includes many modifications which will be obvious to one skilled in the art. For example, the timing sequences shown in FIG. 3 and FIG. 6 can be modified, and the operations described above can be combined in various ways. It is not necessary for the receive systems of the transmit/- receive modules to be checked simultaneously; it is also possible to check them one by one. Also, it is not necessary for the dummy module to be identical to the other modules; unused functions can be eliminated from the dummy module. In the system in FIGS. 1 to 3, for example, the low-noise amplifier function can be removed from the dummy module. The internal configuration of the transmit/receive modules can also be altered by adding or deleting functional elements as necessary. It is furthermore not necessary for the dummy module to be physically installed in the array; it can be located elsewhere with only its dummy antenna element present in the array. The dummy antenna element also need not be part of the array, but can be installed at another nearby location.

It is also possible to provide a plurality of dummy modules and dummy antenna elements in a single array so as to reduce the difference between the distances from the dummy antenna element to the antenna elements for the respective transmit/receive modules.

The apparatus in FIG. 4 and FIG. 6 detected the phase changes of the transmit/receive modules individually and corrected their operation individually, but it is also possible to apply a correction to eliminate the phase differences between all the transmit/receive modules.

What is claimed is:

1. A transmit/receive module test system for a phased-array antenna having a plurality of antenna elements and a plurality of corresponding transmit/receive modules with phase shifters, comprising:

dummy antenna element for transmitting signals to each of said multiple antenna elements simultaneously;

dummy transmit/receive module, connected to said dummy antenna element, for amplifying said signals transmitted by said dummy antenna element prior to their transmission;

wherein each of said plurality of corresponding transmit/receive modules are simultaneously checked for normal receiving operation by said signals transmitted from said dummy antenna element, said dummy transmit/receive module being utilized exclusively for checking the remaining plurality of transmit/receive modules and not operating as such a transmit/receive module of the phased array antenna.

2. A transmit/receive module test system according to claim 1, wherein said plurality of transmit/receive modules comprise receive power detecting means for checking the power of said signals transmitted from said dummy antenna element and received by each of the respective plurality of corresponding antenna elements, thereby checking the transmit/receive modules for normal receiving operation.

3. A transmit/receive module test system according to claim 1, wherein said plurality of transmit/receive modules generate a combined receive output signal, said system further comprising:

a signal line for supplying a dummy transmit signal to said dummy module; and a phase detector means for receiving said dummy transmit signal from said signal line and receiving said combined receive output signal from said plurality of transmit/receive modules, detecting the phase of said dummy transmit signal and said combined receive output signal, and generating a phase difference signal indicating their phase difference.

4. A transmit/receive module test system according to claim 3, further comprising:

means responsive to the phase difference signal, for calculating changes in the phase difference and causing said phase shifters, in each of said plurality of transmit/receive modules, to be adjusted according to the calculated changes in said phase difference signal.

5. A transmit/receive module test system according to claim 1, wherein said phased-array antenna provides a transmit input signal to said transmit/receive modules for transmission from respective antenna elements, and said dummy module, by amplifying said signals received by said dummy antenna element from said antenna elements, generates a dummy receive output signal, said system further comprising:

a phase detector means for receiving said transmit input signal and said dummy receive output signal, detecting their phase difference, and generating a phase difference signal indicating their phase difference.

6. A transmit/receive module test system according to claim 5, further comprising:

means responsive to the phase difference signal, for calculating changes in the phase difference signal and causing said phase shifters, in each of said plurality of transmit/receive modules, to be adjusted according to the calculated changes in said phase difference signal.

7. A transmit/receive module test system according to claim 1, wherein said dummy module comprises:

a receive power detector means for checking the power of said signal received by said dummy antenna element from said multiple antenna elements.

8. A transmit/receive module test system according to claim 1, wherein said dummy module is substantially identical to said transmit/receive modules.

9. A transmit/receive module test system according to claim 1, wherein said dummy antenna element is installed as one antenna element of said phased-array antenna.

10. A system for simultaneously checking each of a plurality of transmit/receive modules with corresponding antenna elements, of a phased array antenna for normal operation during signal reception, said system comprising:

a dummy module means for receiving an input test signal of a predetermined power;

a dummy antenna element means, connected to said dummy module means, for simultaneously transmitting said test signal to each of said plurality of transmit/receive modules, wherein each of said plurality of transmit/receive modules compares the power of said received test signal to a predetermined reference power to thereby simultaneously check each of said plurality of transmit/receive modules for normal operation during signal reception;

said dummy module means and dummy antenna element means being utilized only for checking the remaining plurality of transmit/receive modules and not operating as a transmit/receive module and an antenna element of the phased array antenna.

11. A system, as claimed in claim 10, wherein each of said plurality of transmit/receive modules further comprises:

receive power detector means for detecting the power of said test signal and comparing said detected power to a predetermined reference power to thereby check each corresponding transmit/-receive module for normal operation during signal reception.

12. A system, as claimed in claim 10, wherein each of said plurality of antenna element, corresponding to each of said plurality of transmit/receive modules, receives said test signal transmitted from said dummy antenna element means and subsequently inputs said test signal to each corresponding transmit/receive module.

13. A system for selectively checking for a change in the transmission phase of signal received by each of a plurality of transmit/receive modules, with corresponding antenna elements, said system comprising:

dummy module means for receiving an input test signal of a predetermined phase;

phase detector means for receiving said input test signal of a predetermined phase simultaneously with said dummy module means;

dummy antenna element means, connected to said dummy module means, for receiving said test signal and transmitting it to an antenna element, corresponding to a selected transmit/receive module desired to be checked;

said antenna element, connected to said selected transmit/receive module, inputting said transmitted test signal to said selected transmit/receive module;

said selected transmit/receive module outputting said test signal to said phase detector means; and said phase detector means comparing the phase of said input test signal, of a predetermined phase, to the phase of said test signal outputted from said selected transmit/receive module to thereby detect any change in phase occurring during transmission of said test signal.

14. A system, as claimed in claim 13, further comprising:

phase difference calculator means, connected to said phase detector means, for calculating the phase difference in said change of phase detected by said phase detector means; and phase shifter means, connected to said phase difference calculator means, for shifting a phase control signal by said phase difference calculated to thereby correct the transmission phase of signals received by the selected transmit/receive module.

15. A system, as claimed in claim 13, wherein each of said plurality of transmit/receive modules is sequentially selected, and subsequently checked for a change in the transmission phase of signals received by the selected transmit/receive module, by use of a module control signal.

16. A system, as claimed in claim 14, wherein each of said plurality of transmit/receive modules is suquentially selected, and subsequently checked and corrected for a change in the transmission phase of signals received by the selected transmit/receive module, by use of a module control signal.

17. A system, as claimed in claim 13, wherein each of said plurality of transmit/receive modules further comprises:

receive circuit means for receiving signals transmitted to said transmit/receive module; and wherein said system selectively checks for a change in the transmission phase of signals received by said receive circuit means in said selected transmit/-receive module.

18. A system, as claimed in claim 16, wherein each of said plurality of transmit/receive modules further comprises:

receive circuit means for receiving signals transmitted to said transmit/receive module; and wherein said system sequentially checks for a change in the transmission phase of signals received by each of said receive circuit means in each of said receive circuit means in each of said transmit/-receive modules sequentially selected.

19. A system for selectively checking for a change in the transmission phase of signals transmitted by each of a plurality of transmit/receive modules, with corresponding antenna elements, said system comprising:

a selected transmit/receive module for receiving an input test signal of a predetermined phase;

phase detector means for receiving said input test signal of a predetermined phase simultaneous to said selected transmit/receive module;

antenna element, connected to said selected transmit/receive module, for receiving said test signal and transmitting it to a dummy antenna element, corresponding to a dummy module;

said dummy antenna element, connected to said dummy module, inputting said test signal to said dummy module;

said dummy module outputting said test signal to said phase detector means; and said phase detector means comparing the phase of said input test signal of a predetermined phase to the phase of said test signal outputted from said dummy module to thereby detect any change in phase occurring during transmission of said test signal transmitted by said selected transmit/receive module.

20. A system, as claimed in claim 19, further comprising:

phase difference calculator means, connected to said phase detector means, for calculating the phase difference in said change of phase detected by said phase detector means; and phase shifter means, connected to said phase difference calculator means, for shifting a phase control signal by said phase difference calculated, to thereby correct the transmission phase of signals transmitted by the selected transmit/receive module.

21. A system, as claimed in claim 19, wherein each of said plurality of transmit/receive modules is sequentially selected, and subsequently checked for a change in the transmission phase of signals transmitted by the selected transmit/receive module, by use of a module control signal.

22. A system, as claimed in claim 20, wherein each of said plurality of transmit/receive modules is sequentially selected, and subsequently checked and corrected for a change in the transmission phase of signals transmitted by the selected transmit/receive module, by use of a module control signal.

23. A system, as claimed in claim 19, wherein each of said plurality of transmit/receive modules further comprises:

transmit circuit means for transmitting signals received by said transmit/receive module; and wherein said system selectively checks for a change in the transmission phase of signals transmitted by said transmit circuit means in said selected transmit/receive module.

24. A system, as claimed in claim 22, wherein each of said plurality of transmit/receive modules further comprises:

transmit circuit means for transmitting signals received by said transmit/receive module; and wherein said system sequentially checks for a change in the transmission phase of signals transmitted by each of said transmit circuit means in each of said transmit/receive modules sequentially selected.

25. A method for simultaneously checking each of a plurality of transmit/receive modules with corresponding antenna elements, of a phased array antenna, for normal operation during signal reception, said method comprising the steps of:

(a) inputting a test signal of a predetermined power to a dummy module with a corresponding dummy antenna element;

(b) simultaneously transmitting said test signal from said dummy antenna to each of said plurality of transmit/receive modules;

(c) comparing the power of said test signal, in each of said plurality of transmit/receive modules, to a predetermined reference power to thereby simultaneously check each of said plurality of transmit/-receive modules for normal operation during signal reception.

26. A method, as claimed in claim 25, wherein said step (c) of comparing, further comprises the steps of:

(d) detecting the power of said received test signal, by a receive power detector means in each of said plurality of transmit/receive modules; and (e) comparing said detected power to a predetermined reference power to thereby check each corresponding transmit/receive module for normal operation during signal reception.

27. A method for selectively checking for a change in the transmission phase of signals received by each of a plurality of transmit/receive modules, with corresponding antenna elements, said method comprising the steps of:

(a) inputting a test signal, of a predetermined phase, to a dummy test module signal with a corresponding dummy antenna element;

(b) inputting said test signal of a predetermined phase to a phase detector, simultaneous to said input to said dummy module;

(c) outputting said input test signal from said dummy module to said dummy antenna element;

(d) transmitting said test signal to an antenna element, corresponding to a selected transmit/receive module desired to be checked;

(e) inputting said transmitted test signal to said selected transmit/receive module from said antenna element;

(f) outputting said test signal from said selected transmit/receive module to said phase detector; and (g) comparing, in said phase detector, the phase of said input test signal of a predetermined phase to the phase of said test signal outputted from said selected transmit/receive module to thereby detect any change in phase occurring during transmission of said test signal.

28. A method, as claimed in claim 27, further comprising the steps of:

(h) calculating the phase difference, by use of a phase difference calculator, in said change of phase detected by said phase detector; and (i) shifting a phase control signal, by a phase shifter, by said phase difference calculated, to thereby correct the transmission phase of signals received by the selected transmit/receive module.

29. A method, as claimed in claim 27, further comprising the steps of:

(h) sequentially selecting each of said plurality of transmit/receive modules; and (i) checking for a change in the transmission phase of signals received by each selected transmit/receive module, selected by use of a module control signal.

30. A method, as claimed in claim 28, further comprising the steps of:

(j) sequentially selecting each of said plurality of transmit/receive modules; and (k) checking and correcting for a change in the transmission phase of signals received by each selected transmit/receive module, selected by use of a module control signal.

31. A method for selectively checking for a change in the transmission phase of signals transmitted by each of a plurality of transmit/receive modules, with corresponding antenna elements, said method comprising the steps of:

(a) selecting a transmit/receive module, desired to be checked, for receiving an input test signal of a predetermined phase;

(b) sending said input test signal of a predetermined phase to a phase detector, simultaneous to said selected transmit/receive module;

(c) sending said test signal to antenna element, connected to said selected transmit/receive module;

(d) transmitting said test signal to dummy antenna element, corresponding to a dummy module;

(e) inputting said transmitted test signal to said dummy module;

(f) outputting test signal to said phase detector; and (g) comparing the phase of said input test signal of a predetermined phase to the phase of said test signal outputted from said dummy module in said phase detector, to thereby detect any change in phase occurring during transmission of said test signal transmitted by said selected transmit/receive module.

32. A method, as claimed in claim 31, further comprising the steps of:

(h) calculating the phase difference in said change of phase detected by said phase detector; and (i) shifting a phase control signal by said phase difference calculated, to thereby correct the transmission phase of signals transmitted by the selected transmit/receive module.

33. A method as claimed in claim 31, further comprising the steps of:

(h) sequentially selecting each of said plurality of transmit/receive modules; and (i) checking for a change in the transmission phase of signals transmitted by each selected transmit/-receive module, selected by use of a module control signal.

34. A method, as claimed in claim 33, further comprising the steps of:

(j) sequentially selecting each of said plurality of transmit/receive modules; and (k) checking and correcting for a change in the transmission phase of signals transmitted by each selected transmit/receive module, selected by use of a module control signal.

35. A phased-array antenna system comprising:

a plurality of antenna elements;

a plurality of corresponding transmit/receive modules with phase shifters;

a signal line for input of an rf transmit input signal to be fed to said transmit/receive modules and for output an rf receive output signal supplied from said transmit/receive modules;

a branching device connected to said transmit/-receive modules for receiving said rf transmit input signal on said signal line and distributing said rf transmit input signals to said transmit/receive modules, and for receiving said rf receive output signals from said transmit/receive modules and combining said rf receive output signals into a single rf receive output signal for said signal line;

a dummy antenna element for transmitting signals to or receiving signals from said plurality of antenna elements;

a dummy transmit/receive module connected to said dummy antenna element, for amplifying said signals transmitted or received by said dummy antenna element; and a dummy signal line, separate from said signal line, connected to said dummy transmit/receive module for conveying a signal of reference to and from said dummy transmit/receive module.

36. A system according to claim 35, wherein said plurality of transmit/receive modules each comprise receive power detecting means for checking the power of said signals transmitted from said dummy antenna element and received by each of the respective plurality of corresponding antenna elements, thereby checking the transmit/receive modules for normal receiving operation.

37. A system according to claim 35, wherein said plurality of transmit/receive modules generate a combined receive output signal, said system further comprising:

a phase detector means for receiving said dummy transmit signal from said dummy signal line and receiving said combined receive output signal from said plurality of transmit/receive modules, detecting the phase of said dummy transmit signal and said combined receive output signal, and generating a phase difference signal indicating their phase difference.

38. A system according to claim 37, further comprising:

means responsive to the phase difference signal, for calculating changes in the phase difference and causing said phase shifters, in each of said plurality of transmit/receive modules, to be adjusted according to the calculated changes in said phase difference signal.

39. A system according to claim 35, further comprising:

means for providing a transmit input signal to said transmit/receive modules for transmission from respective antenna elements;

said dummy module amplifying said signals received by said dummy antenna element from said antenna elements, to generate a dummy receive output signal; and phase detector means for receiving said transmit input signal and said dummy receive output signal, detecting their phase difference, and generating a phase difference signal indicating their phase difference.

40. A system according to claim 39, further comprising:

means responsive to the phase difference signal, for calculating changes in the phase difference signal and causing said phase shifters, in each of said plurality of transmit/receive modules, to be adjusted according to the calculated changes in said phase difference signal.

41. A system according to claim 35, wherein said dummy module comprises:

receive power detector means for checking the power of said signals received by said dummy antenna element from said plurality of antenna elements.

42. A transmit/receive module test system according to claim 35, wherein said dummy module is substantially identical to said transmit/receive modules.

43. A transmit/receive module test system according to claim 35, wherein said dummy antenna element is installed as one antenna element of said phased-array antenna.

* * * * *